US006307916B1

(12) United States Patent
Rogers et al.

(10) Patent No.: US 6,307,916 B1
(45) Date of Patent: Oct. 23, 2001

(54) HEAT PIPE ASSISTED COOLING OF ROTATING ANODE X-RAY TUBES

(75) Inventors: Carey S. Rogers, Waukesha; Douglas J. Snyder; Michael J. Price, both of Brookfield, all of WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/395,476

(22) Filed: Sep. 14, 1999

(51) Int. Cl.[7] ..... H01J 35/10
(52) U.S. Cl. ..... 378/141; 378/127
(58) Field of Search ..... 378/127, 130, 378/141

(56) References Cited

U.S. PATENT DOCUMENTS

| | | | | |
|---|---|---|---|---|
| 3,719,847 | | 3/1973 | Webster | 313/60 |
| 3,735,175 | * | 5/1973 | Blomgren | 378/127 |
| 4,146,815 | | 3/1979 | Childeric | 313/330 |
| 4,165,472 | | 8/1979 | Wittry | 313/35 |
| 4,501,566 | | 2/1985 | Carlson et al. | 445/28 |
| 5,742,662 | | 4/1998 | Kuhn et al. | 378/138 |

* cited by examiner

*Primary Examiner*—Craig E. Church
(74) *Attorney, Agent, or Firm*—Foley & Lardner; Peter J. Vogel; Michael A. Della Penna

(57) ABSTRACT

An x-ray tube for emitting x-rays which includes an anode assembly and a cathode assembly is disclosed herein. The x-ray tube includes a vacuum vessel, an anode assembly disposed in the vacuum vessel and including a target, a cathode assembly disposed in the vacuum vessel at a distance from the anode assembly, and a heat pipe is supported relative to the anode assembly. The cathode assembly is configured to emit electrons which hit the target of the anode assembly and produce x-rays. The heat pipe transfers thermal energy away from the target through the vacuum vessel. The heat pipe provides for greater thermal transfer down the bearing shaft of the anode assembly, thereby providing greater cooling of the anode assembly.

22 Claims, 5 Drawing Sheets

HEAT PIPE ASSISTED COOLING OF ROTATING ANODE X-RAY TUBES

BACKGROUND OF THE INVENTION

The present invention relates generally to imaging systems. More particularly, the present invention relates to the cooling of rotating anode x-ray tubes.

Electron beam generating devices, such as x-ray tubes and electron beam welders, operate in a high temperature environment. In an x-ray tube, for example, the primary electron beam generated by the cathode deposits a very large heat load in the anode target to the extent that the target glows red-hot in operation. Typically, less than 1% of the primary electron beam energy is converted into x-rays, while the balance is converted to thermal energy. This thermal energy from the hot target is radiated to other components within the vacuum vessel of the x-ray tube, and is removed from the vacuum vessel by a cooling fluid circulating over the exterior surface of the vacuum vessel. Additionally, some of the electrons back scatter from the target and impinge on other components within the vacuum vessel, causing additional heating of the x-ray tube. As a result of the high temperatures caused by this thermal energy, the x-ray tube components are subject to high thermal stresses which are problematic in the operation and reliability of the x-ray tube.

Typically, an x-ray beam generating device, referred to as an x-ray tube, comprises opposed electrodes enclosed within a cylindrical vacuum vessel. The vacuum vessel is typically fabricated from glass or metal, such as stainless steel, copper or a copper alloy. As mentioned above, the electrodes comprise the cathode assembly that is positioned at some distance from the target track of the rotating, disc-shaped anode assembly. Alternatively, such as in industrial applications, the anode may be stationary.

The target track, or impact zone, of the anode is generally fabricated from a refractory metal with a high atomic number, such as tungsten or tungsten alloy. A typical voltage difference of 60 kV to 140 kV is maintained between the cathode and anode assemblies to accelerate the electrons. The hot cathode filament emits thermal electrons that are accelerated across the potential difference, impacting the target zone of the anode at high velocity. A small fraction of the kinetic energy of the electrons is converted to high energy electromagnetic radiation, or x-rays, while the balance is contained in back scattered electrons or converted to heat. Ultimately, the back scattered electrons are absorbed by components within the vacuum vessel as heat energy. The x-rays are emitted in all directions, emanating from the focal spot, and may be directed out of the vacuum vessel.

In an x-ray tube having a metal vacuum vessel, for example, an x-ray transmissive window is fabricated into the metal vacuum vessel to allow the x-ray beam to exit at a desired location. After exiting the vacuum vessel, the x-rays are directed to penetrate an object, such as human anatomical parts for medical examination and diagnostic procedures. The x-rays transmitted through the object are intercepted by a detector and an image is formed of the internal anatomy. Further, industrial x-ray tubes may be used, for example, to inspect metal parts for cracks or to inspect the contents of luggage at airports.

Since the production of x-rays in an x-ray tube is by its nature a very inefficient process, the components in x-ray generating devices operate at elevated temperatures. For example, the temperature of the anode focal spot can run as high as about 2700° C., while the temperature in the other parts of the anode may range up to about 1800° C.

Additionally, all of the components of a conventional x-ray tube insert must be able to withstand the high temperature exhaust processing when the vacuum vessel is evacuated, at temperatures that may exceed very high temperatures for a relatively long duration.

To cool the x-ray tube insert, the thermal energy generated during tube operation must be radiated from the anode to the vacuum vessel and be ultimately removed by a cooling fluid circulating over the exterior of the x-ray tube insert vacuum vessel. The vacuum vessel is typically enclosed in a casing filled with circulating, cooling fluid, such as dielectric oil. The casing supports and protects the x-ray tube and provides for attachment to a computed tomography (CT) system gantry or other structure. Also, the casing is lined with lead to provide stray radiation shielding. The cooling fluid often performs two duties: cooling the vacuum vessel, and providing high voltage insulation between the anode and cathode connections in the bipolar configuration.

Additionally, this conventional approach becomes even more problematic when combined with new techniques in x-ray computed tomography, such as fast helical scanning, that require vastly more x-ray flux than previous techniques. Due to the inherent poor efficiency of x-ray production, the increased x-ray flux is purchased at the expense of greatly increased heat load that must be dissipated. As the power of x-ray tubes continues to increase, novel cooling techniques must be developed to remove heat from the rotating anode structures.

Rotating anode x-ray tubes are used in mammography, vascular, and computed tomography x-ray systems. Rotating anode x-ray tubes are also ultimately limited in performance by their heat dissipation rate. The bearing components of the rotating anode typically have a temperature limit which is significantly less than the operating temperature of the rotating anode target. Typically, the rotating anode target operates at temperatures over 1000° C. at the target ID. Consequently, the anode target must be thermally isolated from the bearing shaft by a long thermal barrier such that the temperature drop to the bearings closest to the heat source drops the temperature to below the bearing temperature design limit.

In a conventional rolling element x-ray tube bearing assembly, very little power is removed down the bearing shaft by design. If too much heat is allowed to go down the shaft, the temperature of the bearing races and solid lubricated ball bearings drastically increases and can exceed an acceptable limit. Such conditions lead to premature failure. Therefore, it is necessary to limit the maximum temperature in the bearings. Conversely, it is also desirable if more power could be transferred down the bearing shaft and out of the tube insert to aid in cooling the target. This would ultimately increase the power available from x-ray tube systems and, consequently, would provide greater subject (e.g., patient) throughput by the x-ray tube systems.

Another problem with conventional rotating anode x-ray tubes is that the internal diameter (ID) of the anode target can be extremely hot during operation, thereby reducing the strength of the anode material. This reduction in strength lowers the peak rotational operating speeds of the target. As a result, the peak power at which the x-ray tube can operate is reduced. The limit of anode rotational speed is caused by the peak temperatures under the electron beam. As the target spins faster, the local instantaneous heating under the electron beam is reduced.

Thus, there is a need for an improved method of dissipating heat from the anode of the x-ray tube. Further, there is a need for an x-ray tube which provides increased performance by more effective heat dissipation. Even further, there is a need for an x-ray tube which operates with a cooler anode, providing the capability of faster anode rotation and greater x-ray tube power.

BRIEF SUMMARY OF THE INVENTION

One embodiment of the invention relates to an x-ray tube for emitting x-rays which includes an anode assembly and a cathode assembly. The x-ray tube includes a vacuum vessel, an anode assembly disposed in the vacuum vessel and including a target, a cathode assembly disposed in the vacuum vessel at a distance from the anode assembly, and a heat pipe supported relative to the anode assembly. The cathode assembly is configured to emit electrons which hit the target of the anode assembly and produce x-rays. The heat pipe transfers thermal energy away from the target to the exterior of the vacuum vessel.

Another embodiment of the invention relates to an x-ray tube for emitting x-rays having improved heat dissipation. The x-ray tube includes an electron source emitting electrons, an x-ray source providing x-rays from a bombardment of electrons from the electron source onto a target, and means for locally removing heat energy from the x-ray source.

Another embodiment of the invention relates to a method for dissipating heat from an anode including an electron target in an x-ray tube during operation of the x-ray tube. The method includes bombarding the electron target with electrons, the bombardment producing heat, and transferring heat away from the target with a heat pipe.

Another embodiment of the invention relates to a method of assembling an x-ray tube having a vacuum vessel, an anode assembly, a cathode assembly, and a heat pipe. The method includes locating a vacuum vessel, orienting an anode assembly and a cathode assembly within the vacuum vessel, and fastening a heat pipe to the anode assembly.

Other principle features and advantages of the present invention will become apparent to those skilled in the art upon review of the following drawings, the detailed description, and the appended claims.

BRIEF DESCRIPTION OF THE DRAWINGS

The invention will become more fully understood from the following detailed description, taken in conjunction with the accompanying drawings, wherein like reference numerals denote like elements, in which.

DETAILED DESCRIPTION OF THE INVENTION

Figure 1:
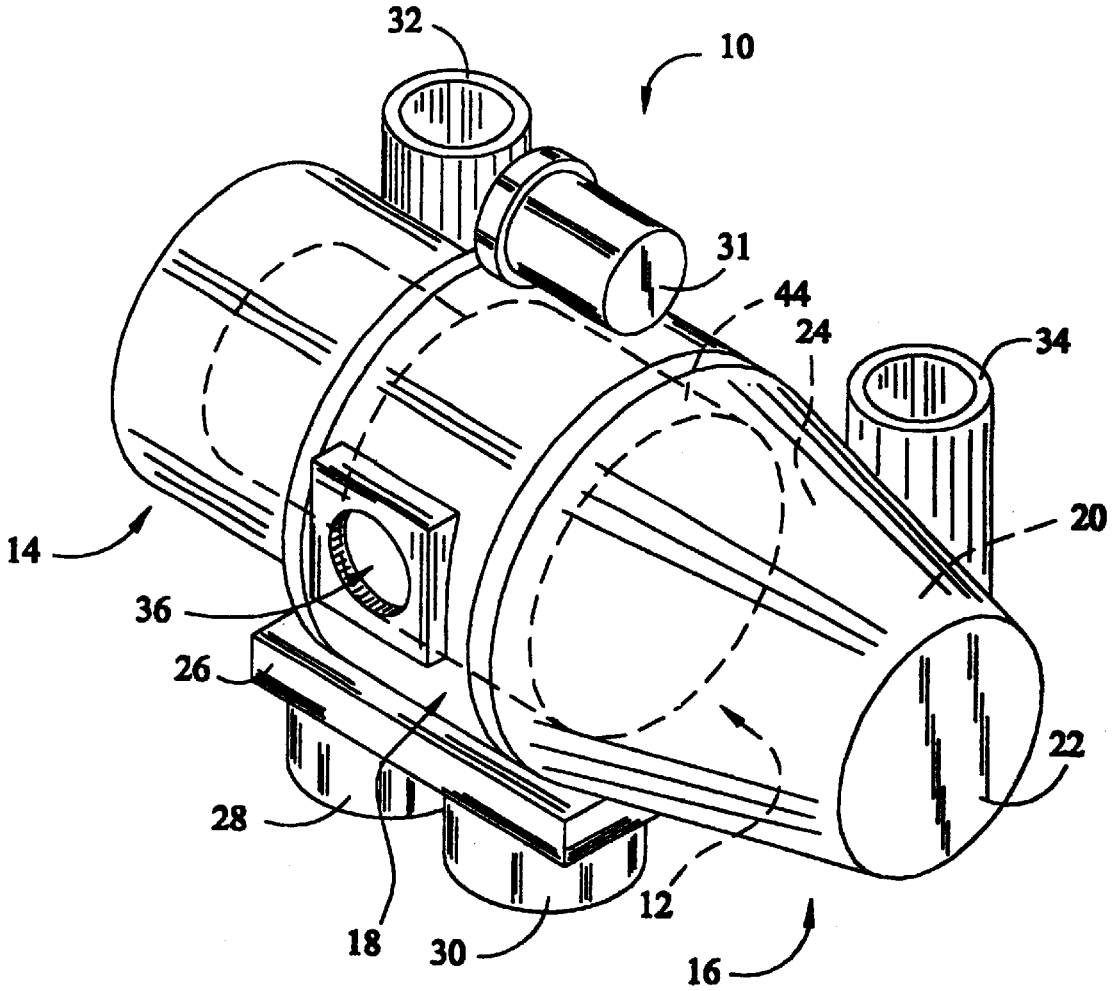
FIG. 1 is a perspective view of a casing enclosing an x-ray tube insert in accordance with an exemplary embodiment of the present invention.

FIG. 1 illustrates an x-ray tube assembly unit 10 for an x-ray generating device or x-ray tube insert 12. X-ray tube assembly unit 10 includes an anode end 14, cathode end 16, and a center section 18 positioned between anode end 14 and cathode end 16. X-ray tube insert 12 is enclosed in a fluid-filled chamber 20 within a casing 22.

Fluid-filled chamber 20 generally is filled with a fluid 24, such as, dielectric oil, which circulates throughout casing 22 to cool x-ray tube insert 12. Fluid 24 within fluid-filled chamber 20 is cooled by a radiator 26 positioned to one side of center section 18. Fluid 24 is moved throughout fluid-filled chamber 20 and radiator 26 by a pump 31. Preferably, a pair of fans 28 and 30 are coupled to radiator 26 for providing cooling air flow over radiator 26 as hot fluid flows through it.

Electrical connections to x-ray tube insert 12 are provided through an anode receptacle 32 and a cathode receptacle 34. X-rays are emitted from x-ray generating device 12 through a casing window 36 in casing 22 at one side of center section 18.

Figure 2:
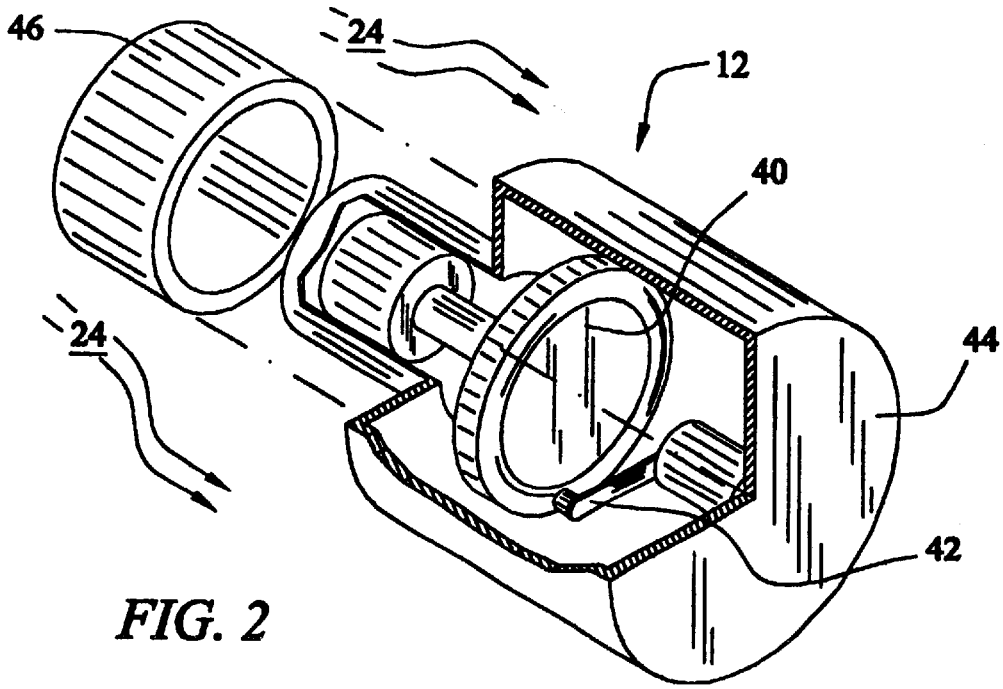
FIG. 2 is a sectional perspective view with the stator exploded to reveal a portion of an anode assembly of the x-ray tube insert of FIG. 1.

As shown in FIG. 2, x-ray tube insert 12 includes a target anode assembly 40 and a cathode assembly 42 disposed in a vacuum within a vessel 44. A stator 46 is positioned over vessel 44 adjacent to target anode assembly 40. Upon the energization of the electrical circuit connecting target anode assembly 40 and cathode assembly 42, which produces a potential difference of, e.g., 60 kV to 140 kV, electrons are directed from cathode assembly 42 to target anode assembly 40. The electrons strike target anode assembly 40 and produce high frequency electromagnetic waves, or x-rays, and residual thermal energy. The residual energy is absorbed by the components within x-ray tube insert 12 as heat. The x-rays are directed out through an x-ray transmissive window pane 48 and casing window 36, which allows the x-rays to be directed toward the object being imaged (e.g., the patient).

Figure 3:
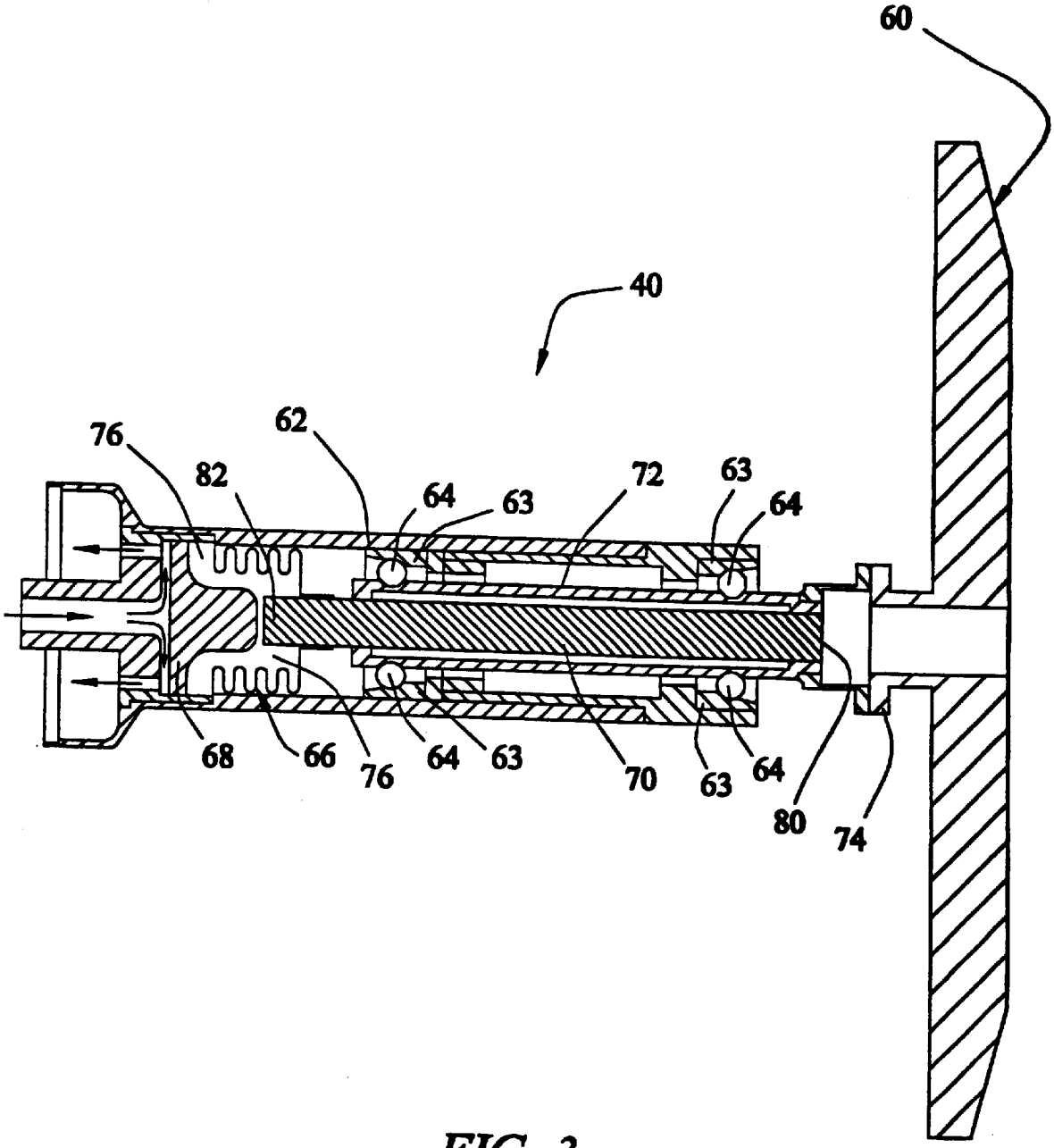
FIG. 3 is a cross sectional view of the anode assembly of the x-ray tube of FIG. 1.

FIG. 3 illustrates a cross sectional view of target anode assembly 40. Target anode assembly 40 includes a target 60, a bearing support 62, bearings 64, corrugated bellows 66, a plug 68, and a heat pipe 70. Target 60 is a metallic disk made of a refractory metal with graphite possibly brazed to it. Target 60 provides a surface against which electrons from cathode assembly 42 strike. In the exemplary embodiment, target 60 rotates by the rotation of a bearing shaft 72 coupled to target 60 by a connector 74. The rotation of target 60 distributes the area on target 60 which is impacted by the electrons.

Bearing support 62 is a cylindrical shaft which provides support for target anode assembly 40. Bearing balls 64 and bearing races 63 are located within bearing support 62 and provide for the rotational movement of target 60 by providing for rotational movement of bearing shaft 72. Bearing balls 64 and bearing races 63 are made of metal and can become softened and even deformed by excessive heat. As such, distributing the heat away from bearing balls 64 and bearing races 63 is important to the proper rotational movement of target 60 and, hence, the proper operation of the x-ray generating device 12.

Corrugated bellows 66 is a metal structure located at the opposite end of bearing support 62 from target 60. Plug 68 is a structure made of a heat conducting material, such as, copper. Corrugated bellows 66 and plug 68 are designed to help dissipate heat away from target 60 and bearings 64. Corrugated bellows 66 and plug 68 define a cavity which is filled with a heat conducting liquid, such as, gallium. Corrugated bellows 66 and plug 68 form a thermal bridge 76 between condenser end 82 of heat pipe 70 and cooling fluid 24 exterior to the vacuum vessel 44.

Figure 5:
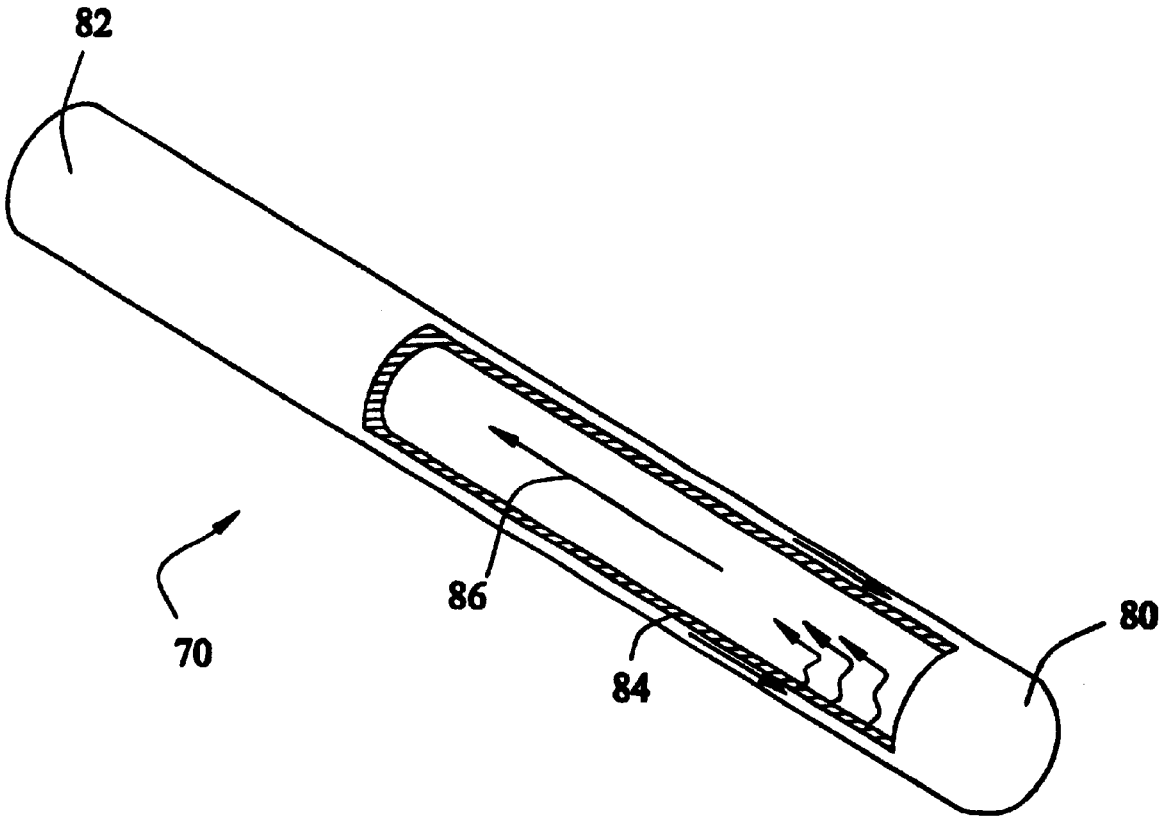
FIG. 5 is a perspective view with partial cross section of a heat pipe included in the anode assembly of the x-ray tube of FIG. 1.

Heat pipe 70 is an evacuated, sealed metal pipe partially filled with a working fluid. As shown in FIG. 5, the internal walls of heat pipe 70 contain a capillary wick structure 84 extending from an evaporator end 80 to a condenser end 82. Capillary wick structure 84 allows heat pipe 70 to operate against gravity by transferring the liquid form of the working fluid to the opposite end of heat pipe 70 where it is vaporized by heat. In general, heat pipe 70 conducts heat away from a source of heat such as target 60.

Heat pipes have found wide application in space-based applications, electronic cooling, and other high-heat-flux applications. For example, heat pipes can be found in satellites, laptop computers, and solar power generators. A wide variety of working fluids have been used with heat pipes, including, nitrogen, ammonia, alcohol, water, sodium, and lithium. Heat pipes have the ability to dissipate very high heat fluxes and heat loads through small cross sectional areas. Heat pipes have a very large effective thermal conductivity and can move a large amount of heat from source to sink. A typical heat pipe can have an effective thermal conductivity more than two orders of magnitude larger than a similar solid copper conductor. Advantageously, heat pipes are totally passive and are used to transfer heat from a heat source to a heat sink with minimal temperature gradients, or to isothermalized surfaces.

In the exemplary embodiment, heat pipe 70 is made of copper and includes water as a working fluid. Alternatively, heat pipe 70 is made of monel, tungsten, stainless steel or some other high temperature material. Heat pipes can be manufactured using a wide range of materials and working fluids spanning the temperature range from cryogenic to molten lithium. High temperature heat pipes, such as, tungsten tube with lithium as the working fluid can be coupled directly to the ID of the anode to transfer heat from the anode. Heat pipes suitable for this application are commercially available.

Figure 4:
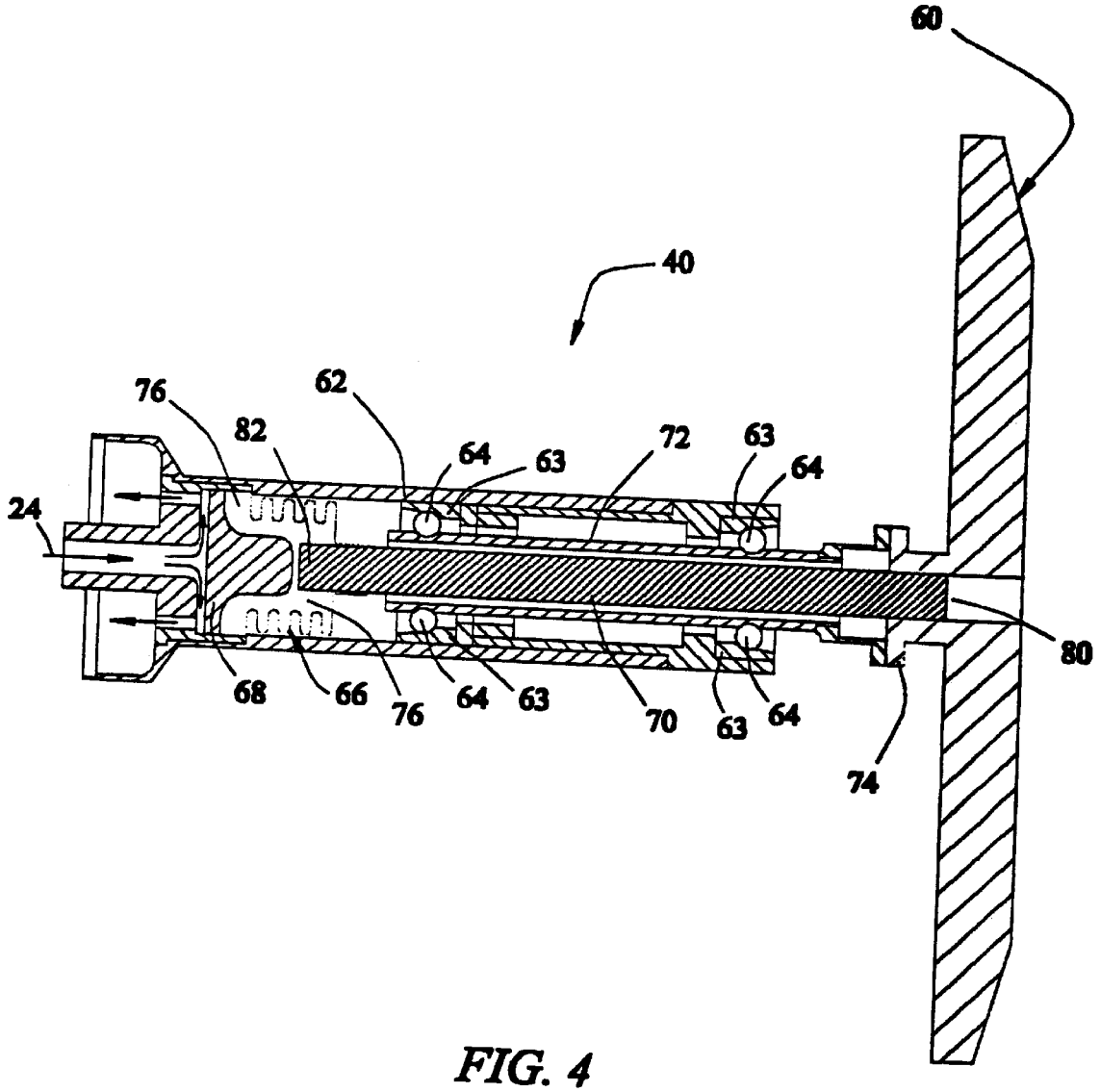
FIG. 4 is a cross sectional view of a secondary embodiment of the anode assembly of the x-ray tube of FIG. 1.

In operation and as illustrated in either FIG. 3 or 4, heat from target 60 enters evaporator end 80 of heat pipe 70 where the working fluid is evaporated, creating a pressure gradient in the pipe. The pressure gradient forces the resulting vapor through the hollow core of heat pipe 70 to the cooler condenser end 82 where the vapor condenses and releases its latent heat of vaporization to the heat sink. The liquid is then wicked back by capillary forces through capillary wick structure 84 to evaporator end 80 in a continuous cycle. For a well designed heat pipe, effective thermal conductivities can range from 10 to 10,000 times the effective thermal conductivity of copper depending on the length of the heat pipe. Due to the cooling effect of the target heat pipe, the bore temperature is reduced. As a result, the yield stress in the material of target 60 is increased. As a result, greater hoop stresses caused by rotating target 60 can be accommodated.

In the exemplary embodiment, evaporator end 80 is attached to the target bore internal diameter at connector 74 (FIG. 4). Heat pipe 70 is thermally isolated from bearing balls 64 and bearing races 63 such that heat conducted through heat pipe 70 does not effect the bearings. Condenser end 82 is located on the opposite side of the bearing support 62. In one embodiment, a thermal bridge is made between the rotating heat pipe and the stationary frame via a liquid metal, such as, gallium. The thermal bridge allows for conductive and convective cooling of condenser end 82. One example of such a thermal bridge is corrugated bellows 66 (FIG. 4).

With heat pipe 70 located at the internal diameter of target 60, the bore of target 60 runs cooler. As such, target anode assembly 40 is capable of faster rotation, providing greater power. Higher scanning power enables faster scans or thinner slices on a CT scanner. This design also allows for more scanning in a given period of time. For vascular x-ray tubes, the cooling provided by heat pipe 70 allows higher power and longer fluoroscopy and cine operation. In the embodiment illustrated in FIG. 3, heat pipe 70 is located within the ID of bearing shaft 72. Such a location for heat pipe 70 is particularly advantageous for reducing bearing temperatures.

X-ray generating device 12 has the benefits of heat pipe 70 integrated with the bearing shaft of a rotating anode x-ray tube. Heat pipe 70 provides greater heat transfer from the anode target, improving the thermal performance of the x-ray tube. Further, heat pipe 70 provides thermal isolation of the bearing balls 64 and bearing races 63 because the center section of heat pipe 70 is adiabatic through the heat pipe wall and isothermal along its length. Heat pipe 70 also provides improved life of the bearing assembly due to lower operating temperatures. Heat pipe 70 provides direct cooling of the joint between the anode and bearing shaft assembly, preventing it from overheating. Additionally, heat pipe 70 provides for greater rotational speeds of the anode, resulting in higher peak power capability of the x-ray tube. Even further, heat pipe 70 provides less focal spot motion due less thermal growth of the bearing shaft assembly.

Figure 6:
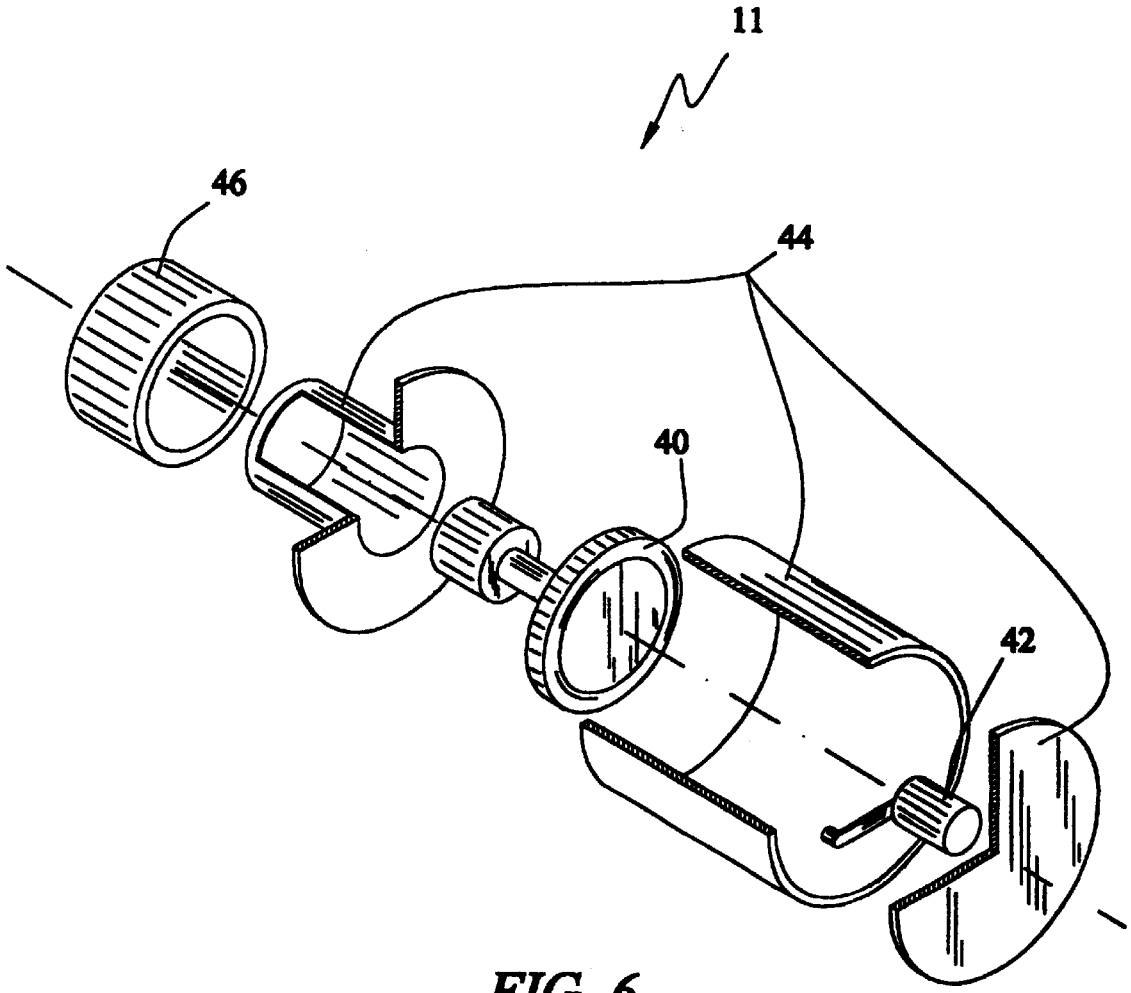
FIG. 6 is an exploded view of the x-ray tube insert of FIG. 1.

FIG. 6 illustrates a portion 11 of unassembled x-ray tube assembly unit 10. Portion 11 includes target anode assembly 40, cathode assembly 42, vacuum vessel 44, and stator 46. The assembly of x-ray tube assembly unit 10 includes locating vacuum vessel 44, orienting anode assembly 40 and cathode assembly 42 within vacuum vessel 44, and fastening heat pipe 70 to anode assembly 40. X-ray tube assembly unit 10 can be repaired or reconstructed by the assembling of portion 11.

While the embodiments illustrated in the FIGURES and described above are presently preferred, it should be understood that these embodiments are offered by way of example only. Other embodiments may include heat pipes in other locations of the anode assembly. Although not preferred, heat pipe 70 may alternatively be made at least partially of a solid thermally conductive material, such as, copper. The invention is not limited to a particular embodiment, but extends to various modifications, combinations, and permutations that nevertheless fall within the scope and spirit of the appended claims.

What is claimed is:

1. An x-ray tube for emitting x-rays which includes an anode assembly and a cathode assembly, the x-ray tube comprising:

a vacuum vessel;

an anode assembly disposed in the vacuum vessel and including a target;

a cathode assembly disposed in the vacuum vessel at a distance from the anode assembly, the cathode assembly being configured to emit electrons which hit the target of the anode assembly and produce x-rays; and a heat pipe supported relative to the anode assembly to transfer thermal energy away from the target via a heat conducting liquid located proximate a condenser end of the heat pipe.

2. The x-ray tube of claim 1, wherein the anode assembly includes a shaft coupled to the vacuum vessel and a support for the target rotatable within the shaft.

3. The x-ray tube of claim 2, wherein the anode assembly further includes bearings which provide for the rotational movement of the rotatable support within the shaft.

4. The x-ray tube of claim 1, wherein the heat pipe comprises an evacuated sealed metal pipe partially filled with a fluid.

5. The x-ray tube of claim 4, wherein the heat pipe includes internal walls having a capillary wick structure, the capillary wick structure providing for the transfer of fluid from one end of the heat pipe to another end irregardless of gravity.

6. The x-ray tube of claim 4, wherein the fluid partially filling the evacuated sealed metal pipe is water.

7. The x-ray tube of claim 1, wherein the heat pipe comprises a portion of solid heat conducting material.

8. The x-ray tube of claim 1, wherein the heat pipe includes, an evaporator end and a condenser end, the evaporator end located near the target and the condenser end located distal to the target.

9. The x-ray tube of claim 8, wherein the evaporator end of the heat pipe is located in an internal diameter of the target.

10. The x-ray tube of claim 8, wherein the condenser end is located proximate a mechanical joint.

11. An x-ray tube for emitting x-rays having improved heat dissipation, the x-ray tube comprising:

an electron source, the electron source emitting electrons;

an x-ray source, the x-ray source providing x-rays from a bombardment of electrons from the electron source onto a target; and means for locally removing heat energy from the target, the means being at least partially located in a cavity containing a heat conducting liquid.

12. The x-ray tube of claim 11, wherein the x-ray source includes a rotating surface upon which the electrons from the electron source bombard and produce x-rays.

13. The x-ray tube of claim 12, wherein the means for locally removing heat energy from the target transfers heat away from an internal diameter of the target.

14. The x-ray tube of claim 12, further comprising a bearing shaft, the bearing shaft including bearings which provide for the rotation of the x-ray source.

15. A method for dissipating heat from an anode including an electron target in an x-ray tube during operation of the x-ray tube, the method comprising:

bombarding the electron target with electrons, the bombardment producing heat; and transferring heat away from the electron target with a heat pipe having a condenser end located in a cavity containing a heat conducting liquid.

16. The method of claim 15, wherein the heat pipe includes an evacuated sealed metal pipe partially filled with fluid and an evaporator end and a condenser end, the transferring heat away from the target step further comprising vaporizing the fluid at the evaporator end and liquefying the vaporized fluid at the condenser end.

17. The method of claim 16, the transferring heat away from the electron target step further comprises providing a thermal bridge structure at the condenser end of the heat pipe.

18. The method of claim 16, the transferring heat away from the electron target step further comprises providing a thermal bridge at the condenser end of the heat pipe.

19. The method of claim 15, wherein the heat pipe comprises a solid pipe made of a heat conducting material.

20. The method of claim 15, the transferring heat away from the electron target step further comprises limiting the temperature at a plurality of bearings in a support to no more than the bearing temperature design limit.

21. A method of assembling an x-ray tube having a vacuum vessel; an anode assembly; a cathode assembly; and a heat pipe, the method comprising:

locating a vacuum vessel;

orienting an anode assembly and a cathode assembly within the vacuum vessel; and fastening a heat pipe to the anode assembly where a condenser end of the heat pipe is surrounded by a cavity configured to hold a heat conducting liquid.

22. The method of claim 21, including the steps of:

disposing the x-ray tube in packaging suitable for shipping; and shipping the packaged x-ray tube to a predetermined location.

* * * * *